US006390773B1

(12) United States Patent
Kajiwara et al.

(10) Patent No.: US 6,390,773 B1
(45) Date of Patent: May 21, 2002

(54) FLUID MACHINERY, A FLANGE FOR FLUID MACHINERY, AND A METHOD FOR MANUFACTURING THEM

(75) Inventors: Kenichi Kajiwara; Akihiro Ohsaki, both of Tokyo; Jun-ichi Sunaga, Kanagawa, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/509,490

(22) PCT Filed: Sep. 30, 1998

(86) PCT No.: PCT/JP98/04408

§ 371 Date: Jun. 19, 2000

§ 102(e) Date: Jun. 19, 2000

(87) PCT Pub. No.: WO99/17022

PCT Pub. Date: Apr. 8, 1999

(30) Foreign Application Priority Data

Sep. 30, 1997 (JP) ..... 9-284383

(51) Int. Cl.[7] ..... F04D 29/44
(52) U.S. Cl. ..... 415/206
(58) Field of Search ..... 415/204, 205, 415/206, 215.1; 72/325, 326; 29/888.02, 889.22

(56) References Cited

U.S. PATENT DOCUMENTS

| | | | | | |
|---|---|---|---|---|---|
| 3,731,742 | A | * | 5/1973 | Sizer et al. | 166/315 |
| 3,826,589 | A | * | 7/1974 | Frank et al. | 415/170 A |
| 5,547,289 | A | * | 8/1996 | Urban | 384/215 |
| 5,763,973 | A | * | 6/1998 | Cramer | 310/103 |
| 5,885,065 | A | * | 3/1999 | Long | 418/1 |

* cited by examiner

*Primary Examiner*—Edward K. Look
*Assistant Examiner*—Ninh Nguyen
(74) *Attorney, Agent, or Firm*—Armstrong, Westerman & Hattori, LLP

(57) ABSTRACT

An annular flange member is provided which is adapted to be provided around a fluid passage opening of a housing of a hydraulic machine to connect a fluid conduit means to the fluid passage opening. The annular flange member comprises an inside surface facing the housing, an outside surface opposite the inside surface, and a through hole extending from the inside surface to the outside surface and fluidly communicated with the fluid passage opening. The outside surface is provided with an O-ring receiving groove surrounding the through hole which is formed by a half die cutting press operation. A hydraulic machine is provided which includes a flange member as noted above.

8 Claims, 4 Drawing Sheets

FLUID MACHINERY, A FLANGE FOR FLUID MACHINERY, AND A METHOD FOR MANUFACTURING THEM

TECHNICAL FIELD

The present invention relates to a hydraulic machine, in particular, a flange member provided around a fluid inlet opening or a fluid outlet opening of a hydraulic machine for connection of the opening with an outside conduit means.

BACKGROUND OF THE INVENTION

In a hydraulic machine such as a pump, it is common for a flange to be provided around a fluid inlet opening and/or a fluid outlet opening so that, when a separate outside conduit means is connected to the opening, a flange provided at an end of the conduit means is aligned with and connected to the flange of the fluid machine and securely fastened by fastener means such as bolts and nuts.

FIG. 5 shows an example of such a conventional flange provided on a hydraulic machine. In this example, a short tubular member 12 is connected at a rim of an opening of the machine at one end thereof and is provided at the other end with a flange member 18 made of a sheet like member. The flange member 18 is provided on its inside surface with an annular reinforcement member 22, and the reinforcement member is supported by a bracket 24. When a conduit member is connected to the flange member 22, a flange of the conduit member is engaged with the flange 18 with a gasket being interposed therebetween and fastened to the flange 18 by means of bolts and nuts or the like.

In this conventional art, the members 22 and 24 for reinforcing the flange 18 are prepared separately from the flange in order to reduce an amount of nonferrous metal material to be used to form elements that come into contact with a fluid passing through the machine in operation thereby reducing costs.

FIG. 6 shows another conventional art in which a flange 30 is integrally formed with a body of a hydraulic machine and machined to form an O-ring receiving groove in its surface. When connected to a conduit means, the flange is provided with an O-ring in the groove to hermetically seal the connection between the flange and the conduit means.

However, the above-noted conventional arts involve the following problems.

In the first conventional art, in order to assure sealing of the connection between the flange member 18 and a conduit means connected thereto, it is necessary for the flange member 18 to have a highly finished surface. However, heat transmitted to the flange member 18 during welding of the reinforcement member 22 to the flange member 18 affects the surface of the flange member 18 and causes a deterioration in the degree of finishing of the surface. Further, since the flange member 18 is generally formed of stainless steel, a friction coefficient of the surface of the flange member 18 is small and thus a gasket interposed between the flange member 18 and a conduit connected thereto tends to slide thereby causing a lowering in sealing therebetween.

The conventional art shown in FIG. 6 involves a problem of high costs in producing the flange 30 as machining of the flange is required to form the O-ring receiving groove 32.

In light of the above-noted problems in the conventional arts, the present invention is directed to a flange member which can facilitate formation of a highly reliable seal and can be produced at low cost, a hydraulic machine with such a flange and a method of production thereof.

DISCLOSURE OF THE INVENTION

The present invention provides an annular flange member adapted to be provided around a fluid passage opening of a housing of a hydraulic machine to connect a fluid conduit means to the fluid passage opening. The annular flange member comprises an inside surface facing the housing, an outside surface opposite the inside surface, and a through hole extending from the inside surface to the outside surface and fluidly communicated with the fluid passage opening. The outside surface is provided with a press formed O-ring receiving groove surrounding the through hole.

The O-ring receiving groove may be formed by a half die cutting press operation.

Specifically, the flange member may include an annular projection formed on the inside surface corresponding to the O-ring receiving groove and a recess formed in the inside surface around a root of the annular projection.

Further, the present invention provides a hydraulic machine including a housing having a fluid passage opening, wherein the hydraulic machine comprises a flange member formed separately from the housing and provided at the fluid passage opening, and the flange member is an annular member having an inside surface facing the housing, an outside surface opposite the inside surface and a through hole extending from the inside surface to the outside surface and fluidly communicated with the fluid passage opening, the outside surface being formed with a press formed O-ring receiving groove therein surrounding the through hole.

Furthermore, the present invention provides a method of producing a flange member provided around a fluid passage opening in a housing of a hydraulic machine. The method comprises the steps of preparing a plate-like member having opposing surfaces including first and second surfaces, forming a through hole in the plate-like member which extends between the first and second surfaces and is adapted to be fluidly communicated with the fluid passage opening, and subjecting the plate-like member to a press operation to form an O-ring receiving groove in the first surface in such a manner that the O-ring receiving groove surrounds the through hole.

The present invention also provides a method of producing a hydraulic machine. The method comprises the steps of producing a housing of the machine provided with a fluid passage opening, and producing a flange separately from the housing adapted to provided around the fluid passage opening. The step of producing the flange comprises preparing a plate-like member having opposing surfaces including first and second surfaces, forming a through hole in the plate-like member which extends between the first and second surfaces and is adapted to be fluidly communicated with the fluid passage opening, and subjecting the plate-like member to a press operation to form an O-ring receiving groove in the first surface in such a manner that the O-ring receiving groove surrounds the through hole.

According to the present invention, a fluid passage opening flange of a hydraulic machine is prepared separately from a housing of the hydraulic machine, whereby it becomes easy to produce the flange. Further, since an O-ring receiving groove is formed in an outside surface thereof on which an opening flange of an outside conduit means is engaged, it is possible to achieve reliable sealing of a connection between the flange and a conduit means connected thereto by placing an O-ring in the O-ring receiving groove.

BEST MODE OF THE INVENTION

With reference to FIGS. 1–4, the present invention will be explained as follows.

Figure 1:
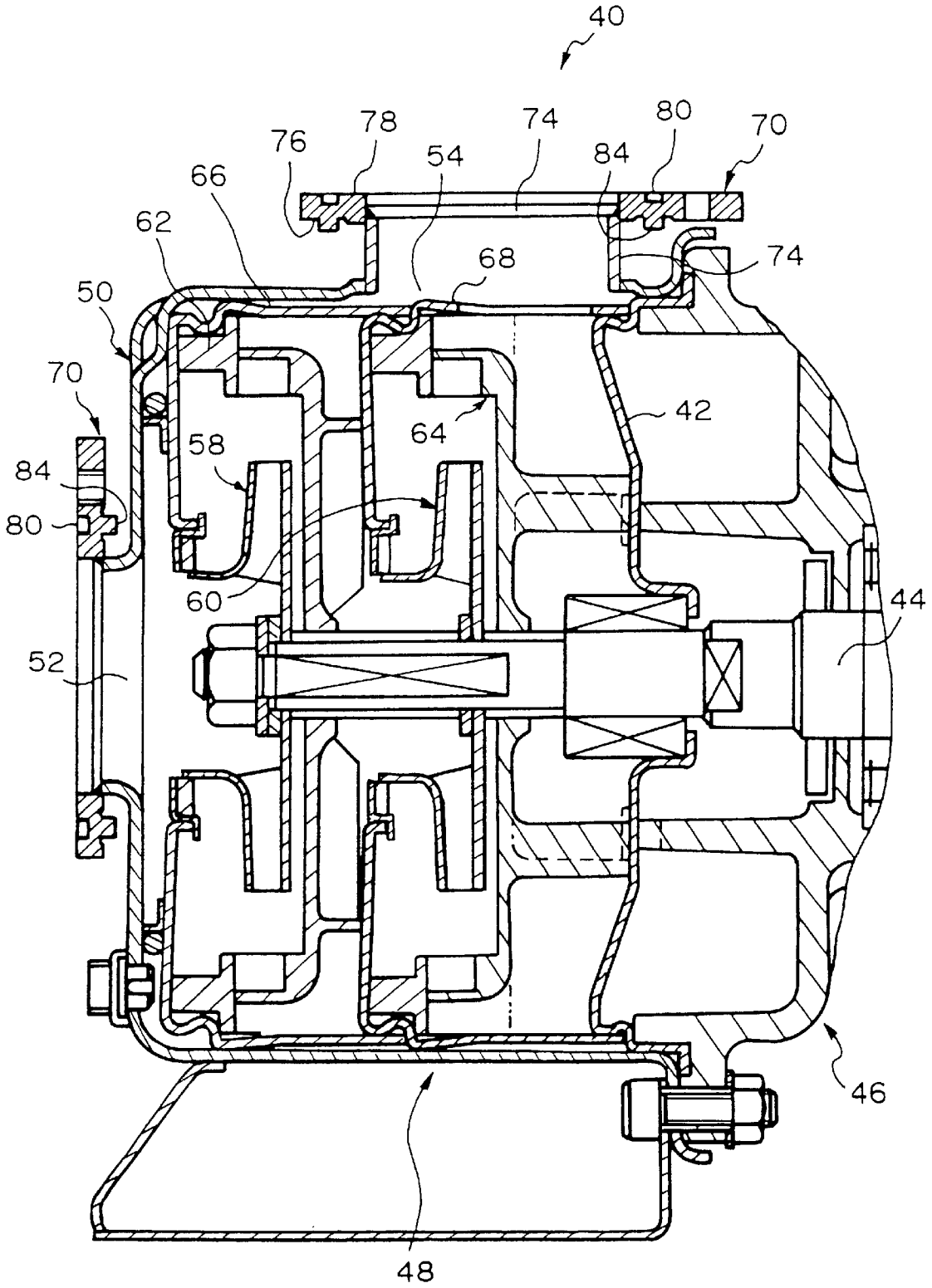
FIG. 1 is a cross sectional view of a hydraulic machine provided with a flange member according to the present invention.
Figure 2:
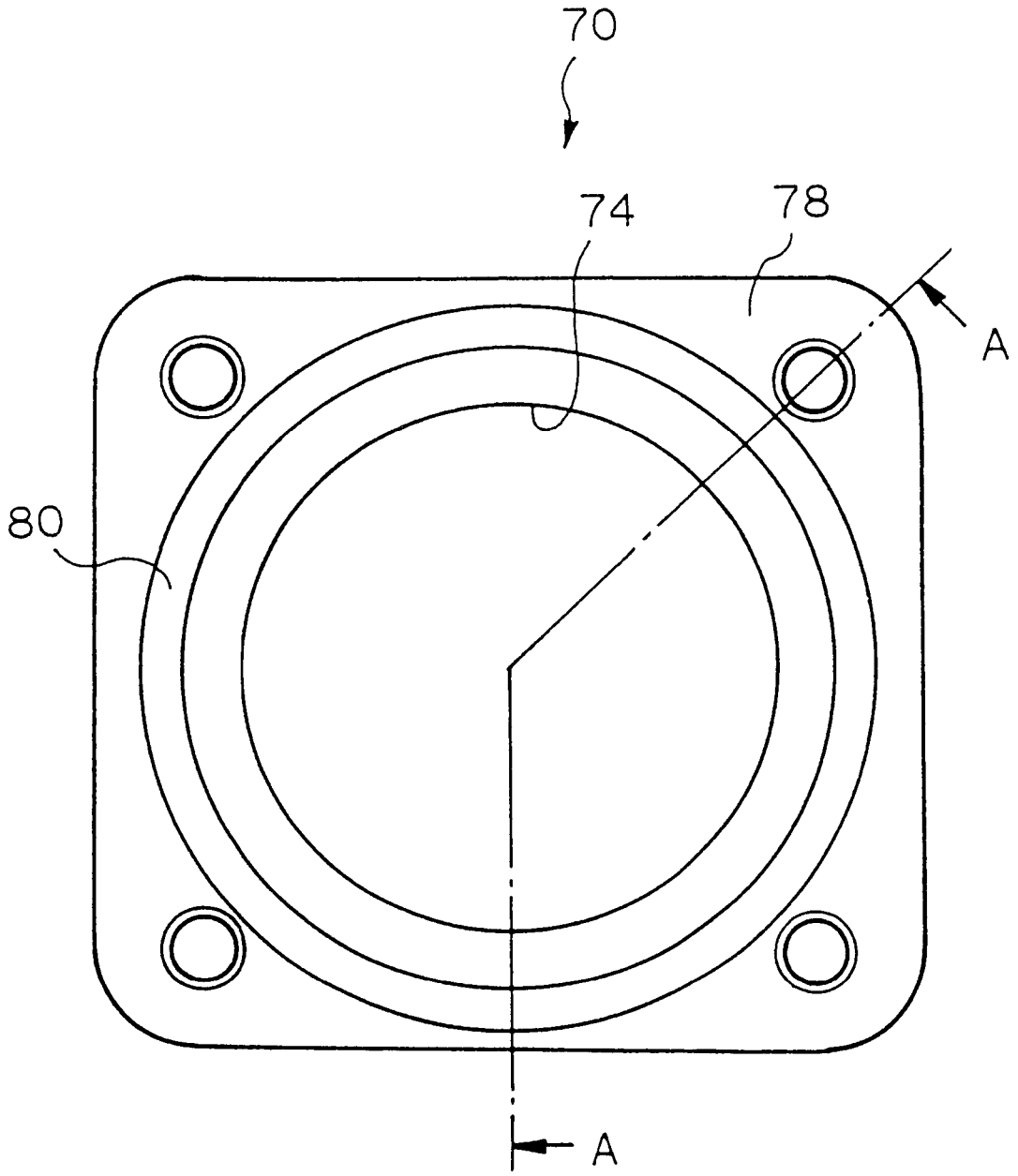
FIG. 2 is a plan view of the hydraulic machine.
Figure 3:
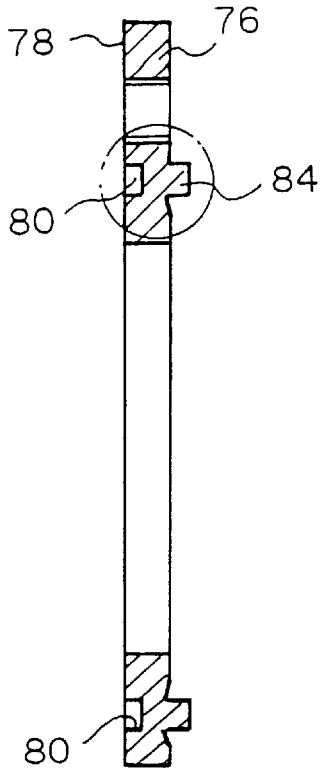
FIG. 3 is a cross sectional view taken along a line A—A in FIG. 2.
Figure 4:
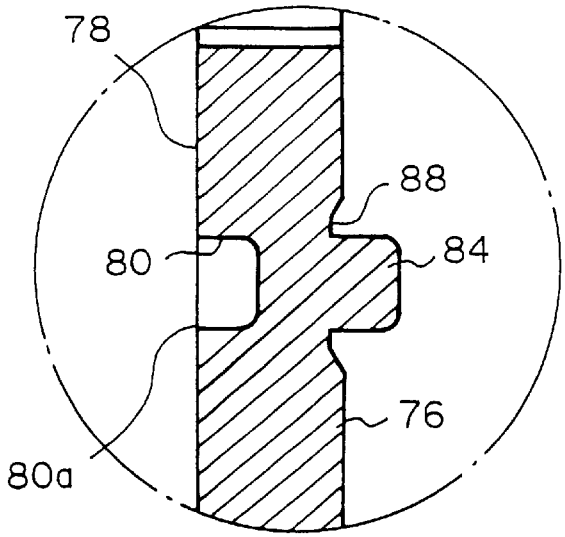
FIG. 4 is an enlarge view of a portion enclosed in a dashed line circle in FIG. 3.
Figure 5:
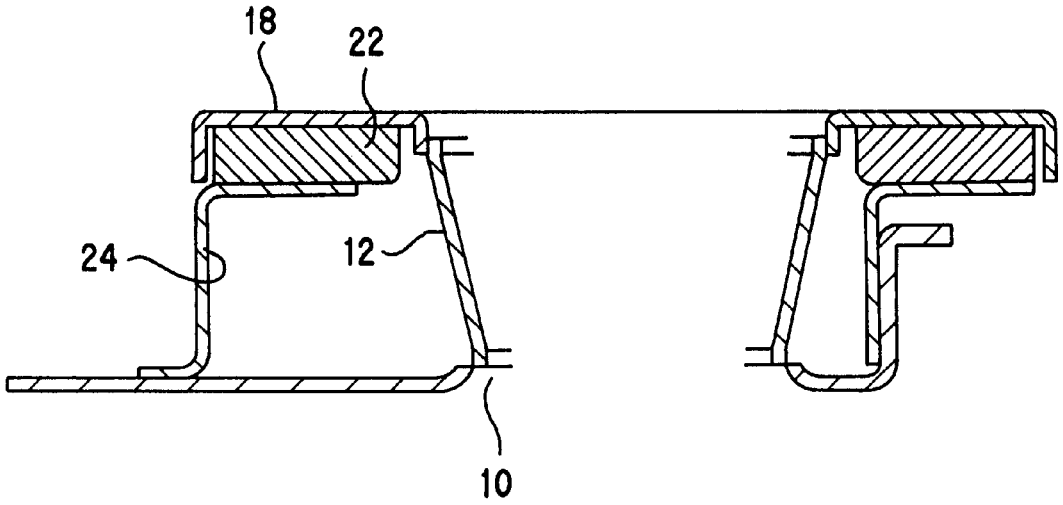
Fig.5 (PRIOR ART)
FIG. 5 is a cross sectional view of the flange according to the first conventional art stated above.
Figure 6:
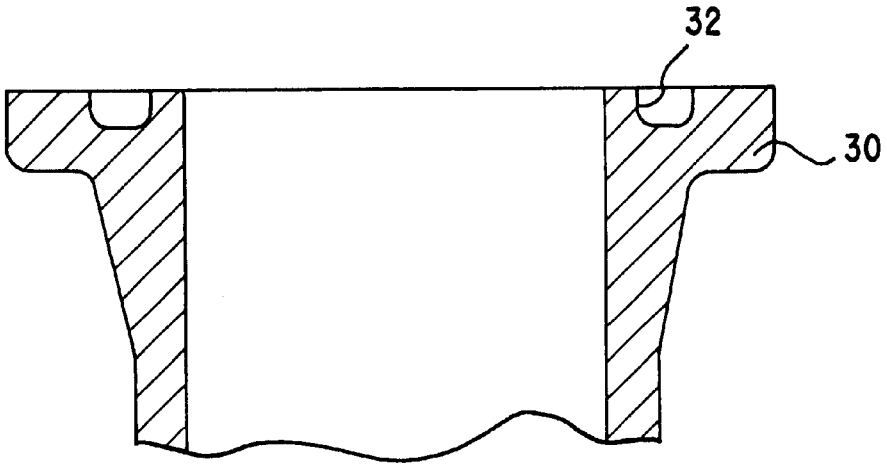
Fig.6 (PRIOR ART)
FIG. 6 is a cross sectional view of the flange according to the second conventional art.

A hydraulic machine in accordance with the present invention or a pump 40 in the embodiment shown in FIG. 1 includes motor part 46 and a pump part 48 with partition wall 42 positioned therebetween and includes a rotational shaft 44 common to the motor and pump parts. A housing 50 of the pump 48 has a fluid inlet opening 52 and a fluid outlet opening 54 and contains therein first and second impellers 58 and 60 fixed to the rotational shaft 44, first and second diffusers 62 and 64 corresponding to the first and second impellers 58 and 60, respectively, and intermediate housings 66 and 68 provided around the first impeller and diffuser and the second impeller and diffuser, respectively, to form first and second pumping chambers 66 and 68.

The inlet opening 52 and the outlet opening 54 are provided with flange members 70 and 70 therearound, respectively. The inlet opening 52 is defined by an annular portion projecting outwardly or leftwardly in FIG. 1 from the housing 50 and the flange member 70 is directly welded to the tip end edge of the annular portion, while the outlet opening is provided with a tubular member 74 and the flange 70 is welded to an outer end edge of the tubular member 74.

The flange member 70 is an annular member defining an opening or through hole 74 and has an inside surface 76 on a side facing the housing 50 and an outside surface 78 on the opposite side which is formed with an O-ring receiving groove 80 encircling the opening 75.

The flange member 70 is formed of a plate-like member having opposing first and second surfaces. The opening 75 is formed by punching and the O-ring receiving groove 80 is formed by a half die cutting operation.

In the half die cutting operation, an annular projection 84 is formed on the inside surface 76 corresponding to the O-ring receiving groove 80. It is preferable to use a die in the half die cutting operation which forms a recess 88 in the inside surface 76 around or adjacent to the root of the annular projection 84. This is because the recess prevents the edges 80*a* of the O-ring receiving groove 80 from shifting towards the inside of the groove.

INDUSTRIAL APPLICATION OF THE INVENTION

The present invention as stated above is applicable to various kinds of hydraulic machines having fluid passage openings to be connected to outside conduit means, enabling openings to be formed at a low cost and to have a high sealing capacity.

What is claimed is:

1. A hydraulic machine including a housing provided with a fluid passage opening, in which:

said hydraulic machine comprises a flange member formed separately from said housing and provided around said fluid passage opening, said flange member is an annular member having an inside surface facing said housing, an outside surface opposite said inside surface and a through hole extending from said inside surface to said outside surface and fluidly communicated with said fluid passage opening, said outside surface being formed with a press formed O-ring receiving groove therein surrounding said through hole, said O-ring receiving groove is formed by a half die cutting press operation, said flange member including an annular projection formed on said inside surface positionally corresponding to said O-ring receiving groove and a recess formed in said inside surface around a root of said annular projection.

2. An annular flange member adapted to be provided around a fluid passage opening of a housing of a hydraulic machine to connect a fluid conduit means to said fluid passage opening, said annular flange member comprising:

an inside surface facing, said housing, an outside surface opposite said inside surface, a through hole extending from said inside surface to said outside surface and fluidly communicated with said fluid passage opening, said outside surface being provided with a press formed O-ring receiving groove surrounding said through hole, said and being formed by a half die cutting press operation, in which said flange member includes an annular projection formed on said inside surface positionally corresponding to said O-ring receiving groove and a recess formed in said inside surface.

3. A method of producing a flange member provided around a fluid passage opening in a housing of a hydraulic machine, preparing a plate-like member having opposing surfaces including first and second surfaces, forming a through hole in said plate-like member which extends between said first and second surfaces and is adapted to be fluidly communicated with said fluid passage opening, and subjecting said plate-like to a pressing operation to form an O-ring receiving groove in said first surface in such a manner that the O-ring receiving groove surrounds said through hole.

4. A method according to claim 3, in which said annular member is subjected to half die cutting to form said O-ring receiving groove.

5. A method according to claim 4, in which said first surface is formed with a projection positionally corresponding to said O-ring receiving groove and a recess around a root of said projection.

6. A method of producing a hydraulic machine, comprising:

producing a housing of the machine provided with a fluid passage opening, and producing a flange separately from said housing adapted to be provided around said fluid passage opening, the step of producing the flange comprising:

preparing a plate-like member having opposing surfaces including first and second surfaces, forming a through hole in said plate-like member which extends between said first and second surfaces and is adapted to be fluidly communicated with said fluid passage opening, and subjecting said plate-like to a pressing operation to form an O-ring receiving groove in said first surface in such a manner that the O-ring receiving groove surrounds said through hole.

7. A method according to claim 6, in which said annular member is subjected to a half die cutting operation to form said O-ring receiving groove.

8. A method according to claim 7, in which said first surface is formed with a projection corresponding to said O-ring receiving groove and a recess around a root of said projection.

* * * * *